United States Patent [19]

Roddy

[11] 4,190,123

[45] Feb. 26, 1980

[54] ROCK DRILL BIT LOADING DEVICE

[76] Inventor: John Roddy, 312 Laidlaw Blvd., Winnipeg, Manitoba, Canada

[21] Appl. No.: 924,625

[22] Filed: Jul. 14, 1978

[30] Foreign Application Priority Data

Jul. 20, 1977 [GB] United Kingdom ..... 30482/77

[51] Int. Cl.[2] ..... E21B 17/10

[52] U.S. Cl. ..... 175/325; 308/4 A

[58] Field of Search ..... 175/322, 323, 325, 113, 175/114, 118, 121, 94, 57, 101, 230, 106, 99, 98, 345, 267, 268, 269; 308/4 A

[56] References Cited

U.S. PATENT DOCUMENTS

| | | | |
|---|---|---|---|
| 1,582,243 | 4/1925 | Hebsacker | 175/106 X |
| 2,669,431 | 2/1954 | Crowell | 175/113 X |
| 2,669,441 | 2/1954 | Castanoli et al. | 175/325 X |
| 2,825,534 | 3/1958 | Reid | 175/322 X |
| 2,886,288 | 5/1959 | Gehrke | 175/325 X |
| 3,180,436 | 4/1965 | Kellner et al. | 175/230 X |
| 3,204,709 | 9/1965 | Barton | 175/113 X |
| 3,977,481 | 8/1976 | Fisk et al. | 175/345 |

*Primary Examiner*—James A. Leppink
*Assistant Examiner*—Richard E. Favreau
*Attorney, Agent, or Firm*—Stanley G. Ade

[57] ABSTRACT

A plurality of piston and cylinder assemblies extend radially from the wall of the drill tube above the drill bit. A roller assembly is journalled in the distal ends of the pistons and engages the wall of the bore hole. The pistons are urged outwardly by fluid pressure to engage the wall and they are inclined approximately 10° from the longitudinal axis of the drill string so that when the drill string is rotated, the engagement of the inclined rollers against the wall urges the drill bit downwardly thus assisting in applying the required pressure to the rotating bit.

14 Claims, 6 Drawing Figures

ROCK DRILL BIT LOADING DEVICE

BACKGROUND OF THE INVENTION

This invention relates to new and useful improvements in drilling, particularly in drilling in rock formations.

Conventionally, a drill bit is situated at the bottom end of a drill string and rotation is supplied to the entire drill string and drill bit from the ground surface. Pressure is applied to the drill bit not only by the weight of the drill string but also by additional weight such as that applied by weight collars around the string just above the drill bit at the bottom of the hole.

This conventional method requires considerable weight and is relatively slow in operation and, if downward pressure is applied mechanically, considerable mechanism is required.

Furthermore, the drill string is basically suspended from the rig in order to prevent buckling of the drill string due to the static weight thereof.

Devices exist which eliminate the heavy collars used to increase the downward force exerted upon a drill bit, and which use hydraulic pressure to force a section of the drill string above the drill bit into contact with the sides of the drill hole. All of these require that the portion of the string or pipe in contact with the hole remain stationary, while some other device is used to push against this part of the drill string thus exerting a downward force upon the drill bit.

However, these devices require a totally different method of operation for the drill bit and cannot be adapted for use with conventional, rotatable drill strings.

SUMMARY OF THE INVENTION

The present invention overcomes these disadvantages by providing a drill bit on the lower end of a drill string, with means just above the drill bit to urge the drill bit downwardly as the drill bit is rotated.

In general, I provide one or more arms extending from the drill string just above the drill bit which bear against the wall of the drill bore and which include means which are angled downwardly so that a screw thread effect is obtained thus applying downward pressure to the drill bit, and means are also provided to apply pressure upon the wall engaging ends of the arms to urge them into contact with the walls.

This not only reduces the necessity of additional weight and downward pressure but also applies the pressure immediately above the drill bit rather than at the top of the drill string which can then be almost fully supported from the upper end thereof.

Although the device is generally designed to be secured to the drill pipe just above the drill bit, nevertheless more than one unit may be utilized in a drilling operation as for example, every thousand feet of drill pipe may incorporate one of the devices to assist in the provision of the necessary downward pressure to the drill bit.

Although in certain circumstances, pressure from the top of the hole can be eliminated, in the majority of cases the use of the present device enables the pressure to be reduced considerably.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
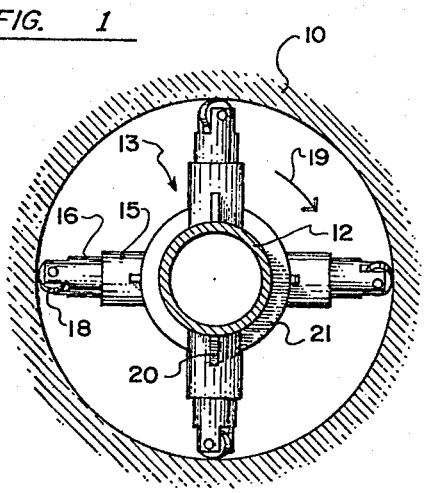
FIG. 1 is a top plan schematic view of a drill bore showing the device therein.
Figure 2:
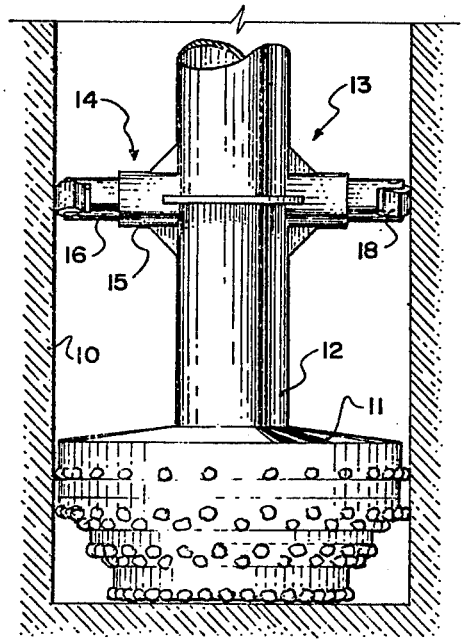
FIG. 2 is a schematic side view of one embodiment of the device.
Figure 3:
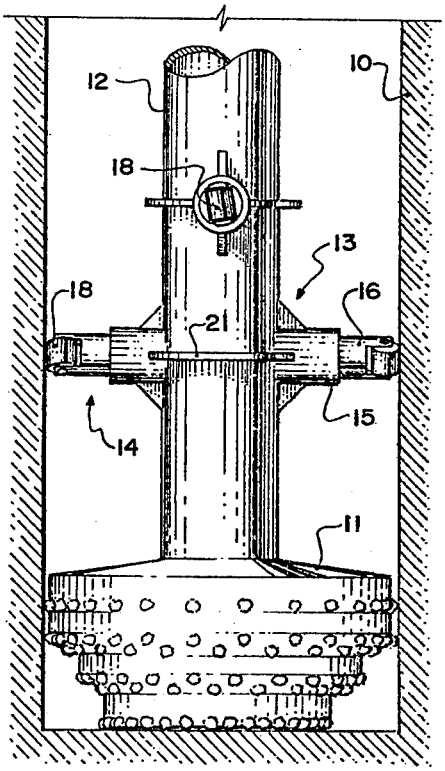
FIG. 3 is a schematic side view of the embodiment of the device shown in FIG. 1.

Proceeding therefore to describe the invention in detail, reference character 10 illustrates the side wall of a drill hole or bore formed in the ground by a conventional drill bit 11 which is secured to the lower end of a conventional drill string or pipe 12 extending downwardly from the ground surface (not illustrated). Drilling fluid (not illustrated) under pressure passes down through the drill pipe or string to the bit 11 to cool the bit and wash away or remove the chips, debris, etc. This drilling fluid is then returned to the surface by any one of a variety of conventional means (not illustrated).

The device collectively designated 13 consists of one or more assemblies 14 extending outwardly from the drill pipe or string 12 just above the drill bit 11.

Each assembly 14 includes a pipe or tube 15 mounted to the wall of the drill pipe by any conventional means and extending radially therefrom. A plunger or piston 16 is telescopically mounted within each pipe or tube 15 and hydraulic means are provided normally to urge the plunger outwardly in contact with the wall 10 of the drill hole or bore as will hereinafter be described.

The distal end of the plunger 16 is provided with a roller assembly 18 to facilitate rotary movement against the wall of the hole, said roller assembly being mounted for rotation upon a pin 17 extending between pins 17A formed on the end of the plunger 16.

It is desirable that the roller bearing 18 be inclined relative to the vertical axis of the hole so that rotary movement of the drill pipe or string causes the bearing assemblies to take up a slightly spiral movement in the form of a screw threading action thus applying pressure to the drill bit 11, when the drill bit is rotated in the direction of arrow 19 (see FIG. 1).

Conversely, of course, when the rotation of the drill string is reversed, the devices 13 assist in withdrawing the drill string by taking the weight of the drill bit and urging the drill string upwardly so that each section of drill pipe can be removed as it clears the surface.

As will be seen from the details of the drawings, the pipes or tubes 15 are preferably supported from the wall of the drill pipe by means of diagonal flanges 20 and, if necessary, by the ring flanges 21. Needless to say, other support methods can be provided, if desired.

The individual pistons 16 within the tubes or cylinders 15 are restricted insofar as outward motion is concerned and drawings 5 and 7 show the preferred method.

A spring loaded stopper key or piston ring 22 surrounds the piston 16 adjacent the inner end thereof and this rides in an annular channel 23 formed within the cylinder 15 by the annular flange 24 on the outer end of the cylinder and the inner flange 25 on the inner end thereof.

Springs 26 may react between the base of the piston ring or key groove 27 and the key or ring 22 to urge same outwardly as shown in FIG. 7. This prevents over-extension of the piston 16 or collapse into the center of the drill rod.

Alternatively, the spring loaded stopper key or ring can be set into the cylinder with a suitable groove being cut into the piston. This is shown in FIG. 7 in phantom and includes a longitudinally extending groove 28 within the wall of the piston 16 with a pin or stopper 29 engaging through an apertures within the wall of the cylinder with spring 30 reacting between the pin 29 and a screw 31 engaging within a boss 32 formed in the wall of the cylinder. The particular advantage of this embodiment is the fact that it maintains the angle of inclination of the cylinder and hence the roller at the desired degree of between, for example, 5° and 10° from the vertical thus assisting in the screw threading action hereinbefore described.

Figure 6:
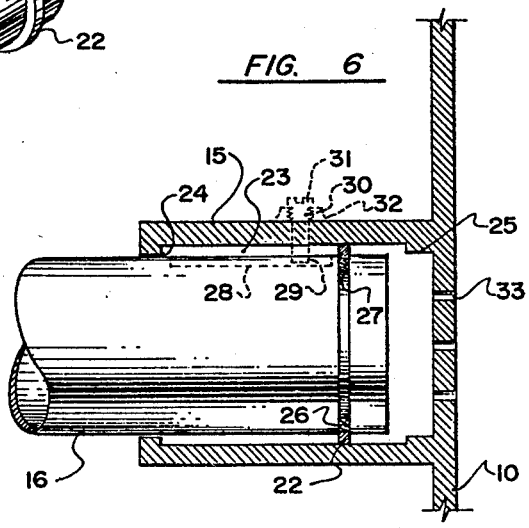
FIG. 6 is a fragmentary vertical section of one of the piston and cylinder assemblies.

Hydraulic pressure to urge the pistons outwardly may either be provided by a separate hydraulic system extending from the surface (not illustrated) or, from the pressure of the drilling fluid passing downwardly through the drill string and being restricted as to release thereof by the conventional discharge aperture normally formed within the drill bit so that the drilling fluid within the drill string is always maintained at a predetermined pressure which may act through apertures 33 formed within the drill string wall as clearly shown in FIG. 6.

Figure 4:
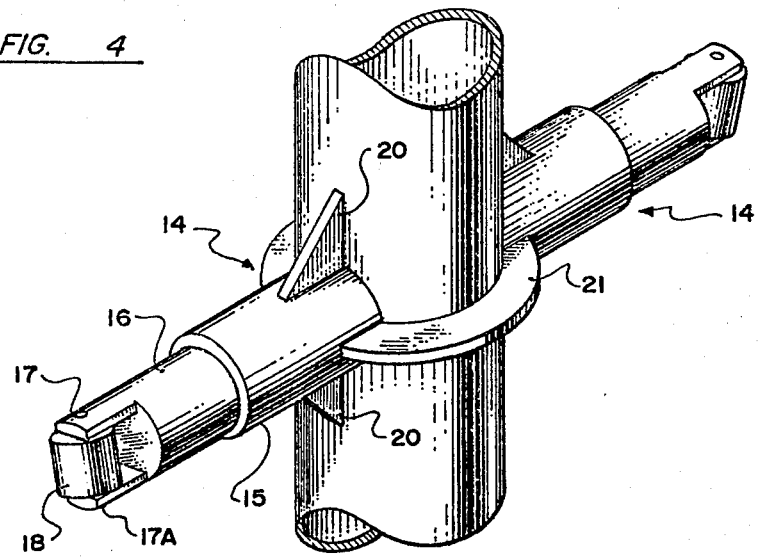
FIG. 4 is an isometric view of the device per se.
Figure 5:
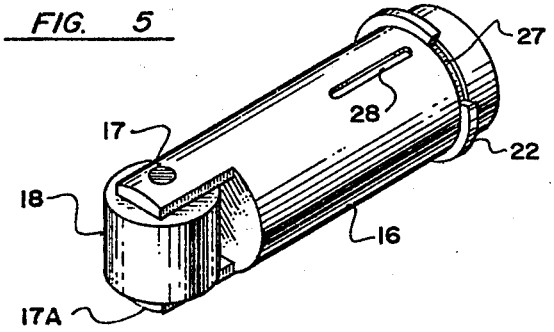
FIG. 5 is an isometric view of one of the piston and roller assemblies per se.

Preferably, two pairs of diametrically situated assemblies 14 are provided, one in one horizontal plane and the other at right angles thereto in a horizontal plane spaced therefrom as illustrated in FIG. 4.

Although only one set of rollers is shown, nevertheless, a plurality of sets could be provided in a length of drill stem immediately above the drill bit.

In operation, a series of extendable rollers are fixed above a conventional drill bit and are used to exert force against the side wall of the drill hole and by having the rollers mounted at an angle to the longitudinal axis of the drill string, any rotational motion applied to the drill string from the surface, yields extra downward force upon the rock surface below the drill bit.

The rollers are readily retracted back into the drill string by releasing the hydraulic pressure so that the whole apparatus can be lifted or repositioned in the bore hole. It will be appreciated that the device requires that the whole shaft be in constant rotation so that the force is continuously bearing upon the drill bit as it proceeds through the rock so that it is adapted for use with rotational drill bits only and not percussive drill bits.

As drilling fluid under high pressure is normally required to remove the debris of drilling, this fluid can also be used to activate the extension of the roller assemblies.

As mentioned previously, other patents exist for devices which allow downward pressure to be exerted upon a drill bit, but these are stationary and do not rotate with the drill string.

Although the present description and drawings illustrate a drill bit operated from the surface by means of a drill string, nevertheless it will be appreciated that the rotational force may be supplied to the drill string immediately above the drill bit and above the present devices by means of a source of power either hydraulic or electric which may be lowered by cable or the like. However, once again, similar principles may be used in that the downward pressure is supplied by devices extending from the drill pipe and rotating therewith.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A rock drill bit loading device in which said drill bit is mounted on the lower end of a rotatable drill string within a bore hole and includes a source of hydraulic pressure and a source of drilling fluid within said drill string, comprising in combination at least two bore hole wall engaging assemblies extending radially outwardly from the wall of the drill string and rotating therewith, means to apply outward pressure to said assemblies, to engage same with the wall of the bore hole and means to translate the frictional engagement of said assemblies with the wall of the bore hole, to downward pressure upon the drill bit when said drill string and bit is rotating in one direction and to release said downward pressure when rotating in the opposite direction.

2. The device according to claim 1 in which each of said assemblies includes a cylinder secured to and extending from said wall of the drill string, a piston reciprocal in said cylinder and bore hole wall engaging means on the distal end of said piston.

3. The device according to claim 2 which includes means cooperating between said piston and cylinder to limit inward and outward movement of said piston relative to said cylinder.

4. The device according to claim 3 in which said last mentioned means includes a spring loaded ring around said piston, an annular channel in said cylinder, said ring reciprocating in said channel as said piston reciprocates in said cylinder.

5. The device according to claim 2 in which each of said assembly includes a roller journalled for rotation within the distal end of said piston and engaging the wall of the bore hole, said roller being inclined at an angle from the vertical axis of the bore hole.

6. The device according to claim 3 in which each of said assembly includes a roller journalled for rotation within the distal end of said piston and engaging the wall of the bore hole, said roller being inclined at an angle from the vertical axis of the bore hole.

7. The device according to claim 4 in which each of said assembly includes a roller journalled for rotation within the distal end of said piston and engaging the wall of the bore hole, said roller being inclined at an angle from the vertical axis of the bore hole.

8. The device according to claim 5 which includes means to maintain the inclination of said roller, said last mentiond means including a pin extending from said cylinder wall and engaging within a longitudinal extending groove in said piston whereby said piston moves longitudinally within said cylinder but is non-rotatable relative to said cylinder.

9. The device according to claim 6 which includes means to maintain the inclination of said roller, said last mentioned means including a pin extending from said cylinder wall and engaging within a longitudinal extending groove in said piston whereby said piston moves longitudinally within said cylinder but is non-rotatable relative to said cylinder.

10. The device according to claim 7 which includes means to maintain the inclination of said rollers, said last mentioned means including a pin extending from said cylinder wall and engaging within a longitudinal extending groove in said piston whereby said piston moves longitudinally within said cylinder but is non-rotatable relative to said cylinder.

11. The device according to claims 1, 2 or 3 in which said wall engaging assemblies are equidistantly spaced around said wall of said drill stem and in which there are at least two sets of said assemblies, one set being in a plane above the other of said sets and extending from the wall of said drill string.

12. The device according to claims 4, 5 or 6 in which said wall engaging assemblies are equidistantly spaced around said wall of said drill stem and in which there are at least two sets of said assemblies, one set being in a plane above the other of said sets and extending from the wall of said drill string.

13. The device according to claims 7, 8 or 9 in which said wall engaging assemblies are equidistantly spaced around said wall of said drill stem and in which there are at least two sets of said assemblies, one set being in a plane above the other of said sets and extending from the wall of said drill string.

14. The device according to claims 1, 2 or 3 in which said means to apply outward pressure to said assembly includes said source of hydraulic pressure operatively connected to said assembly, said source of hydraulic pressure being utilized from the pressure of said drilling fluid extending through said drill string.

* * * * *